US007381297B2

(12) United States Patent
Hernandez-Munoa et al.

(10) Patent No.: US 7,381,297 B2
(45) Date of Patent: Jun. 3, 2008

(54) FIBROUS STRUCTURE AND PROCESS FOR MAKING SAME

(75) Inventors: Diego Antonio Hernandez-Munoa, Liberty Township, OH (US); Kenneth Douglas Vinson, Cincinnati, OH (US); Dale Gary Kavalew, Cincinnati, OH (US); Patrick Kip Edwards, Cincinnati, OH (US); John Allen Manifold, Milan, IN (US)

(73) Assignee: The Procter & Gamble Company, Cincinnati, OH (US)

( * ) Notice: Subject to any disclaimer, the term of this patent is extended or adjusted under 35 U.S.C. 154(b) by 237 days.

(21) Appl. No.: 10/374,559

(22) Filed: Feb. 25, 2003

(65) Prior Publication Data

US 2004/0163781 A1 Aug. 26, 2004

(51) Int. Cl.

| | |
|---|---|
| ***D21H 11/00*** | (2006.01) |
| ***D21H 17/00*** | (2006.01) |
| ***D21H 27/30*** | (2006.01) |
| ***B32B 5/02*** | (2006.01) |

(52) U.S. Cl. ..... 162/123; 162/129; 162/135; 162/149; 162/158; 162/164.1; 162/179; 428/172

(58) Field of Classification Search ..... 162/91, 162/95–99, 109, 158, 179, 164.1, 123–133, 162/204, 207, 141, 149, 135; 428/537.5, 428/340, 172

See application file for complete search history.

(56) References Cited

U.S. PATENT DOCUMENTS

| | | | | |
|---|---|---|---|---|
| 3,994,771 | A * | 11/1976 | Morgan et al. | 162/113 |
| 4,300,981 | A | 11/1981 | Carstens | |
| 5,147,505 | A * | 9/1992 | Altman | 162/129 |
| 5,397,435 | A | 3/1995 | Ostendorf et al. | |
| 5,405,499 | A * | 4/1995 | Vinson | 162/100 |
| 5,405,501 | A | 4/1995 | Phan et al. | |
| 5,573,637 | A * | 11/1996 | Ampulski et al. | 162/112 |
| 5,582,685 | A * | 12/1996 | Vinson | 162/55 |
| 5,635,028 | A * | 6/1997 | Vinson et al. | 162/111 |
| H1672 | H * | 8/1997 | Hermans et al. | 162/148 |
| 5,785,813 | A | 7/1998 | Shanklin et al. | |
| 6,074,527 | A | 6/2000 | Hsu et al. | |
| 6,149,769 | A | 11/2000 | Mohammadi et al. | |
| 6,241,850 | B1 | 6/2001 | Kelly | |
| 6,277,241 | B1 * | 8/2001 | Merker et al. | 162/111 |
| 6,413,363 | B1 * | 7/2002 | Hsu et al. | 162/4 |
| 6,419,790 | B1 * | 7/2002 | Leege et al. | 162/112 |
| 6,468,391 | B1 | 10/2002 | Sharyo et al. | |
| 6,827,819 | B2 * | 12/2004 | Dwiggins et al. | 162/123 |
| 6,896,768 | B2 * | 5/2005 | Dwiggins et al. | 162/123 |
| 2002/0084048 | A1 * | 7/2002 | Merker et al. | 162/123 |
| 2002/0162635 | A1 * | 11/2002 | Hsu et al. | 162/55 |
| 2004/0163781 | A1 * | 8/2004 | Hernandez-Munoa et al. | 162/91 |
| 2004/0163782 | A1 * | 8/2004 | Hernandez-Munoa et al. | 162/91 |
| 2004/0221975 | A1 * | 11/2004 | Hernandez-Monoa et al. | 162/135 |
| 2004/0231812 | A1 * | 11/2004 | Hernandez-Munoa | 162/109 |
| 2007/0187055 | A1 * | 8/2007 | Manifold et al. | 162/125 |

FOREIGN PATENT DOCUMENTS

| | | |
|---|---|---|
| EP | 0 806 521 A2 | 11/1997 |
| EP | 0 806 520 B1 | 11/2002 |
| WO | WO 97/27363 | 7/1997 |
| WO | WO 98/23813 | 6/1998 |
| WO | WO 99/25924 | 5/1999 |
| WO | WO 00/26467 | 5/2000 |

OTHER PUBLICATIONS

Paperi ja Puu; Paavilainen, Leena. "Quality competiveness of Asian short-fibre raw materials in different paper grades" vol. 82, No. 3 : 156-161, Apr. 2000.

International Search Report Dated Jul. 12, 2007.

* cited by examiner

*Primary Examiner*—José A Fortuna
(74) *Attorney, Agent, or Firm*—C. Brant Cook; Betty J. Zea; David M. Weirich

(57) ABSTRACT

Fibrous structures, especially fibrous structures incorporated into facial tissue, toilet tissue and paper towel and napkin products, that comprise a fiber having a length of from about 0.4 mm to about 1.2 mm and a coarseness of from about 3.0 mg/100 m to about 7.5 mg/100 m, wherein the fibrous structures exhibit a lint value of greater than about 3.5 to about 15, and processes for making such fibrous structures are provided.

10 Claims, No Drawings

FIBROUS STRUCTURE AND PROCESS FOR MAKING SAME

FIELD OF THE INVENTION

The present invention relates to fibrous structures, especially fibrous structures incorporated into facial tissue, toilet tissue, paper towel and napkin products, that comprise a fiber having a length of from about 0.4 mm to about 1.2 mm and a coarseness of from about 3.0 mg/100 m to about 7.5 mg/100 m, wherein the fibrous structures exhibit a lint value of greater than about 3.5 to about 15.

BACKGROUND OF THE INVENTION

Typically, fibrous structures used for sanitary tissue products contain two or more fiber furnishes. Such fibrous structures typically contain one furnish comprised of relatively long fibers, i.e. fibers with length-weighted average fiber length exceeding about 2 mm. This furnish is intended as reinforcement or strength generation. Then the fibrous structures further comprise at least one relatively short fibered furnish, i.e. having a fiber length less than about 1 mm. The short fibers improve the softness since they are relatively unbonded. The unbonded fibers allow free ends which impart a velvety smoothness to the structure. See U.S. Pat. No. 4,300,981 to Carstens incorporated herein by reference for a disclosure of such velvety structures.

It is well known to those skilled in the art that the use of the short fibers is limited both in the minimum average fiber length which is permissible as well as the fraction of the total furnishes which can be the short-fibered furnish. This is due to the well known fact that use of shorter and shorter fibers normally causes an increase in the propensity of a tissue paper structure to release lint. While a certain amount of lint level is acceptable, excessive lint can be a major problem in production (dust generation). The users of product can also negatively relate to lint as it causes dust accumulation around the home of leaves pieces of the tissue clinging to the body after use.

This problem with lint is heightened when the tissue paper product is made by the so-called through-air dried ("TAD") papermaking process. This is because the process of tieing-down loose lint is improved when the tissue paper web is pressed against the surface of a Yankee dryer. In some TAD processes, this pressing is changed from pressing over 100% of the area, typical in non-TAD conventional processes, to less than 50%, more preferably even less than 40% of the surface. While the lint reduction accompanying such limited pressing is surprisingly good, it necessarily suffers relative to conventional web making. Furthermore in some TAD processes, the Yankee dryer has been eliminated completely which obviously totally eliminates this means of strength generation.

Today's art limits the short-fibered furnish used in papermaking processes to greater than about 0.75 mm.

Inventors have now found that, in fibrous tissue structures having lint values greater than about 3.5, surprisingly short fiber length, i.e. from about 0.4 mm to about 1.2 mm fibers, can be used in the production and use of such tissue paper structures offering a softness benefit without a substantial increase in lint values.

No prior art teaches a fibrous structure comprising a short fiber having a length of from about 0.4 mm to about 1.2 mm and a coarseness of from about 3.0 mg/100 m to about 7.5 mg/100 m, wherein the fibrous structure has a lint value of greater than about 3.5.

SUMMARY OF THE INVENTION

The present invention provides a fibrous structure that exhibits a lint value of greater than about 3.5.

In one aspect of the present invention, a fibrous structure comprising a short fiber furnish comprising a short fiber having a length of from about 0.4 mm to about 1.2 mm and a coarseness of from about 3.0 mg/100 m to about 7.5 mg/100 m, wherein the fibrous structure has a lint value of greater than about 3.5 to about 15, is provided.

In another aspect of the present invention, a paper product comprising a fibrous structure according to the present invention is provided.

In yet another aspect of the present invention, a sanitary tissue product comprising a fibrous structure according to the present invention, wherein the sanitary tissue product is selected from the group consisting of facial tissue products, toilet tissue products, napkins, paper towel products and mixtures thereof, is provided.

In still another aspect of the present invention, a process for making a fibrous structure comprising the steps of:

a. preparing a fibrous furnish comprising a short fiber furnish comprising a soft fiber having a length of from about 0.4 mm to about 1.2 mm and a coarseness of from about 3.0 mg/100 m to about 7.5 mg/100 m, by mixing the short fiber with water to form the short fiber furnish;

b. depositing the fibrous furnish on a foraminous forming surface to form an embryonic fibrous web; and c. drying the embryonic web, is provided.

In even another aspect of the present invention, a process for making a soft fibrous structure comprising the steps of:

a. identifying a first fiber that exhibits a softness value greater than a second fiber, wherein a fibrous structure comprising the first fiber has a lint value equal to or less than a fibrous structure comprising the second fiber; and b. incorporating the first fiber into a fibrous structure to form the soft fibrous structure, is provided.

In still even another aspect of the present invention, a process for making a soft fibrous structure comprising the steps of:

a. identifying a first fiber, that when incorporated into a first fibrous structure at a level of at least 10% by weight of the total fibers present in the first fibrous structure, exhibits a first softness value and a first lint value;

b. identifying a second fiber, that when incorporated into a second fibrous structure at the same level as the first fiber is incorporated into the first fibrous structure, exhibits a second softness value which is less than the first softness value and a second lint value which is greater than the first lint value; and c. incorporating the first fiber into a fibrous structure to form the soft fibrous structure; and d. optionally, incorporating the soft fibrous structure into a paper product, is provided.

In yet even another aspect of the present invention, a soft fibrous structure made by a process according to the present invention is provided.

All documents cited are, in relevant part, incorporated herein by reference; the citation of any document is not to be construed as an admission that it is prior art with respect to the present invention.

DETAILED DESCRIPTION OF THE INVENTION

"Fiber" as used herein means a elongate particulate having an apparent length greatly exceeding its apparent width, i.e. a length to diameter ratio of at least about 10. More specifically, as used herein, "fiber" refers to papermaking fibers. The present invention contemplates the use of a variety of fibers papermaking fibers, such as, for example, synthetic fibers, or any other suitable fibers, and any combination thereof. Papermaking fibers useful in the present invention include cellulosic fibers commonly known as wood pulp fibers. Applicable wood pulps include chemical pulps, such as Kraft, sulfite, and sulfate pulps, as well as mechanical pulps including, for example, groundwood, thermomechanical pulp and chemically modified thermomechanical pulp. Chemical pulps, however, may be preferred since they impart a superior tactile sense of softness to tissue sheets made therefrom. Pulps derived from both deciduous trees (hereinafter, also referred to as "hardwood") and coniferous trees (hereinafter, also referred to as "softwood") may be utilized. The hardwood and softwood fibers can be blended, or alternatively, can be deposited in layers to provide a stratified web. U.S. Pat. No. 4,300,981 and U.S. Pat. No. 3,994,771 are incorporated herein by reference for the purpose of disclosing layering of hardwood and softwood fibers. Also applicable to the present invention are fibers derived from recycled paper, which may contain any or all of the above categories as well as other non-fibrous materials such as fillers and adhesives used to facilitate the original papermaking.

In addition to the various wood pulp fibers, other cellulosic fibers such as cotton linters, rayon, and bagasse can be used in this invention. Synthetic fibers, such as polymeric fibers, can also be used. Elastomeric polymers, polypropylene, polyethylene, polyester, polyolefin, and nylon, can be used. The polymeric fibers can be produced by spunbond processes, meltblown processes, and other suitable methods known in the art.

The embryonic web can be typically prepared from an aqueous dispersion of papermaking fibers, though dispersions in liquids other than water can be used. The fibers are dispersed in the carrier liquid to have a consistency of from about 0.1 to about 0.3 percent. It is believed that the present invention can also be applicable to moist forming operations where the fibers are dispersed in a carrier liquid to have a consistency less than about 50 percent, more preferably less than about 10%.

"Sanitary tissue product" as used herein means a soft, low density (i.e. <about 0.15 g/cm3) web useful as a wiping implement for post-urinary and post-bowel movement cleaning (toilet tissue), for otorhinolaryngolical discharges (facial tissue), and multi-functional absorbent and cleaning uses (absorbent towels).

"Weight average molecular weight" as used herein means the weight average molecular weight as determined using gel permeation chromatography according to the protocol found in Colloids and Surfaces A. Physico Chemical & Engineering Aspects, Vol. 162, 2000, pg. 107-121.

"Wet Burst Strength" as used herein is a measure of the ability of a fibrous structure and/or a paper product incorporating a fibrous structure to absorb energy, when wet and subjected to deformation normal to the plane of the fibrous structure and/or paper product. Wet burst strength may be measured using a Thwing-Albert Burst Tester Cat. No. 177 equipped with a 2000 g load cell commercially available from Thwing-Albert Instrument Company, Philadelphia, Pa.

Wet burst strength is measured by taking eight (8) fibrous structures according to the present invention and staking them in four pairs of two (2) samples each. Using scissors, cut the samples so that they are approximately 228 mm in the machine direction and approximately 114 mm in the cross machine direction, each two finished product units thick. First, age the samples for two (2) hours by attaching the sample stack together with a small paper clip and "fan" the other end of the sample stack by a clamp in a 107° C. (±3° C.) forced draft oven for 5 minutes (±10 seconds). After the heating period, remove the sample stack from the oven and cool for a minimum of three (3) minutes before testing. Take one sample strip, holding the sample by the narrow cross machine direction edges, dipping the center of the sample into a pan filled with about 25 mm of distilled water. Leave the sample in the water four (4) (±0.5) seconds. Remove and drain for three (3) (±0.5) seconds holding the sample so the water runs off in the cross machine direction. Proceed with the test immediately after the drain step. Place the wet sample on the lower ring of a sample holding device of the Burst Tester with the outer surface of the sample facing up so that the wet part of the sample completely covers the open surface of the sample holding ring. If wrinkles are present, discard the samples and repeat with a new sample. After the sample is properly in place on the lower sample holding ring, turn the switch that lowers the upper ring on the Burst Tester. The sample to be tested is now securely gripped in the sample holding unit. Start the burst test immediately at this point by pressing the start button on the Burst Tester. A plunger will begin to rise toward the wet surface of the sample. At the point when the sample tears or ruptures, report the maximum reading. The plunger will automatically reverse and return to its original starting position. Repeat this procedure on three (3) more samples for a total of four (4) tests, i.e., four (4) replicates. Report the results as an average of the four (4) replicates, to the nearest g.

"Basis Weight" as used herein is the weight per unit area of a sample reported in lbs/3000 $ft^2$ or $g/m^2$. Basis weight is measured by preparing one or more samples of a certain area ($m^2$) and weighing the sample(s) of a fibrous structure according to the present invention and/or a paper product comprising such fibrous structure on a top loading balance with a minimum resolution of 0.01 g. The balance is protected from air drafts and other disturbances using a draft shield. Weights are recorded when the readings on the balance become constant. The average weight (g) is calculated and the average area of the samples ($m^2$). The basis weight ($g/m^2$) is calculated by dividing the average weight (g) by the average area of the samples ($m^2$).

"Machine Direction" or "MD" as used herein means the direction parallel to the flow of the fibrous structure through the papermaking machine and/or product manufacturing equipment.

"Cross Machine Direction" or "CD" as used herein means the direction perpendicular to the machine direction in the same plane of the fibrous structure and/or paper product comprising the fibrous structure.

"Total Dry Tensile Strength" or "TDT" of a fibrous structure of the present invention and/or a paper product comprising such fibrous structure is measured as follows. One (1) inch by five (5) inch (2.5 cm×12.7 cm) strips of fibrous structure and/or paper product comprising such fibrous structure are provided. The strip is placed on an electronic tensile tester Model 1122 commercially available from Instron Corp., Canton, Mass. in a conditioned room at a temperature of 73° F. ±4° F. (about 28° C. ±2.2° C.) and a relative humidity of 50%±10%. The crosshead speed of the tensile tester is 2.0 inches per minute (about 5.1 cm/minute) and the gauge length is 4.0 inches (about 10.2 cm). The TDT is the arithmetic total of MD and CD tensile strengths of the strips.

"Caliper" as used herein means the macroscopic thickness of a sample. Caliper of a sample of fibrous structure according to the present invention is determined by cutting a sample of the fibrous structure such that it is larger in size than a load foot loading surface where the load foot loading surface has a circular surface area of about 3.14 $in^2$. The sample is confined between a horizontal flat surface and the load foot loading surface. The load foot loading surface applies a confining pressure to the sample of 15.5 $g/cm^2$ (about 0.21 psi). The caliper is the resulting gap between the flat surface and the load foot loading surface. Such measurements can be obtained on a VIR Electronic Thickness Tester Model II available from Thwing-Albert Instrument Company, Philadelphia, Pa. The caliper measurement is repeated and recorded at least five (5) times so that an average caliper can be calculated. The result is reported in millimeters.

"Apparent Density" or "Density" as used herein means the basis weight of a sample divided by the caliper with appropriate conversions incorporated therein. Apparent density used herein has the units $g/cm^3$.

"Softness" of a fibrous structure according to the present invention and/or a paper product comprising such fibrous structure is determined as follows. Ideally, prior to softness testing, the samples to be tested should be conditioned according to Tappi Method #T4020M-88. Here, samples are preconditioned for 24 hours at a relative humidity level of 10 to 35% and within a temperature range of 22° C. to 40° C. After this preconditioning step, samples should be conditioned for 24 hours at a relative humidity of 48% to 52% and within a temperature range of 22° C. to 24° C. Ideally, the softness panel testing should take place within the confines of a constant temperature and humidity room. If this is not feasible, all samples, including the controls, should experience identical environmental exposure conditions.

Softness testing is performed as a paired comparison in a form similar to that described in "Manual on Sensory Testing Methods", ASTM Special Technical Publication 434, published by the American Society For Testing and Materials 1968 and is incorporated herein by reference. Softness is evaluated by subjective testing using what is referred to as a Paired Difference Test. The method employs a standard external to the test material itself. For tactile perceived softness two samples are presented such that the subject cannot see the samples, and the subject is required to choose one of them on the basis of tactile softness. The result of the test is reported in what is referred to as Panel Score Unit (PSU). With respect to softness testing to obtain the softness data reported herein in PSU, a number of softness panel tests are performed. In each test ten practiced softness judges are asked to rate the relative softness of three sets of paired samples. The pairs of samples are judged one pair at a time by each judge: one sample of each pair being designated X and the other Y. Briefly, each X sample is graded against its paired Y sample as follows:

1. a grade of plus one is given if X is judged to may be a little softer than Y, and a grade of minus one is given if Y is judged to may be a little softer than X;
2. a grade of plus two is given if X is judged to surely be a little softer than Y, and a grade of minus two is given if Y is judged to surely be a little softer than X;
3. a grade of plus three is given to X if it is judged to be a lot softer than Y, and a grade of minus three is given if Y is judged to be a lot softer than X; and, lastly:
4. a grade of plus four is given to X if it is judged to be a whole lot softer than Y, and a grade of minus 4 is given if Y is judged to be a whole lot softer than X.

The grades are averaged and the resultant value is in units of PSU. The resulting data are considered the results of one panel test. If more than one sample pair is evaluated then all sample pairs are rank ordered according to their grades by paired statistical analysis. Then, the rank is shifted up or down in value as required to give a zero PSU value to which ever sample is chosen to be the zero-base standard. The other samples then have plus or minus values as determined by their relative grades with respect to the zero base standard. The number of panel tests performed and averaged is such that about 0.2 PSU represents a significant difference in subjectively perceived softness.

"Ply" or "Plies" as used herein means an individual fibrous structure optionally to be disposed in a substantially contiguous, face-to-face relationship with other plies, forming a multiple ply fibrous structure. It is also contemplated that a single fibrous structure can effectively form two "plies" or multiple "plies", for example, by being folded on itself.

As used herein, the articles "a" and "an" when used herein, for example, "an anionic surfactant" or "a fiber" is understood to mean one or more of the material that is claimed or described.

All percentages and ratios are calculated by weight unless otherwise indicated. All percentages and ratios are calculated based on the total composition unless otherwise indicated.

Unless otherwise noted, all component or composition levels are in reference to the active level of that component or composition, and are exclusive of impurities, for example, residual solvents or by-products, which may be present in commercially available sources.

Fibrous Structure

The fibrous structure of the present invention may comprise a fibrous furnish comprising a short fiber furnish comprising a short fiber having a length of from about 0.4 mm to about 1.2 mm and a coarseness of from about 3.0 mg/100 m to about 7.5 mg/100 in.

In addition to the short fiber, the fibrous structure may comprise a wet strength resin, preferably a permanent wet strength resin. Also, in addition to the short fiber, the fibrous structure may comprise a chemical softener. The fibrous furnish used to make the fibrous structure may further comprise a permanent wet strength resin.

The short fibers having a length of from about 0.4 mm to about 1.2 mm and a coarseness of from about 3.0 mg/100 m to about 7.5 mg/100 m may be present in the fibrous structure at a level of at least 10% by weight of the total fibers, and/or at a level of at least 20% up to 100% by weight of the total fibers of the fibrous structure.

In addition to the short fiber, the fibrous structure of the present invention may include optional ingredients, which are described in more detail below.

In addition to the short fiber furnish, the fibrous furnish of the present invention may further comprise a long fiber furnish comprising a long fiber having a length of greater than 1.2 mm. Nonlimiting examples of these long fibers include fibers derived from wood pulp. Other cellulosic fibrous pulp fibers, such as cotton linters, bagasse, etc., can be utilized and are intended to be within the scope of this invention. Synthetic fibers, such as rayon, polyethylene and polypropylene fibers, can also be utilized in combination with natural cellulosic fibers. One exemplary polyethylene fiber that can be utilized is Pulpex(R), available from Hercules, Inc. (Wilmington, Del.).

Applicable wood pulps include chemical pulps, such as Kraft, especially Northern Softwood Kraft ("NSK"), sulfite, and sulfate pulps, as well as mechanical pulps including, for example, groundwood, thermomechanical pulp and chemically modified thermomechanical pulp. Chemical pulps, however, are preferred since they impart a superior tactile sense of softness to tissue sheets made therefrom. Pulps derived from both deciduous trees (hereafter, also referred to as "hardwood") and coniferous trees (hereafter, also referred to as "softwood") can be utilized. Also useful in the present invention are fibers derived from recycled paper, which can contain any or all of the above categories as well as other non-fibrous materials such as fillers and adhesives used to facilitate the original papermaking.

In addition to wood pulps, fibers may be produced/obtained from vegetable sources such as corn (i.e., starch).

The fibrous structures of the present invention are useful in paper, especially sanitary tissue paper products in general, including but not limited to conventionally felt-pressed tissue paper; high bulk pattern densified tissue paper; and high bulk, uncompacted tissue paper. The tissue paper can be of a homogenous or multi-layered construction; and tissue paper products made therefrom can be of a single-ply or multi-ply construction. The tissue paper may have a basis weight of between about 10 g/m2 to about 65 g/m2, and a density of from about 0.6 g/cc or less.

Conventionally pressed tissue paper and methods for making such paper are well known in the art. Such paper is typically made by depositing a papermaking furnish on a foraminous forming wire, often referred to in the art as a Fourdrinier wire. Once the furnish is deposited on the forming wire, it is referred to as a web. The web is dewatered by pressing the web and drying at elevated temperature. The particular techniques and typical equipment for making webs according to the process just described are well known to those skilled in the art. In a typical process, a low consistency pulp furnish is provided from a pressurized headbox. The headbox has an opening for delivering a thin deposit of pulp furnish onto the Fourdrinier wire to form a wet web. The web is then typically dewatered to a fiber consistency of between about 7% and about 25% (total web weight basis) by vacuum dewatering and further dried by pressing operations wherein the web is subjected to pressure developed by opposing mechanical members, for example, cylindrical rolls. The dewatered web is then further pressed and dried by a steam drum apparatus known in the art as a Yankee dryer. Pressure can be developed at the Yankee dryer by mechanical means such as an opposing cylindrical drum pressing against the web. Multiple Yankee dryer drums can be employed, whereby additional pressing is optionally incurred between the drums. The tissue paper structures that are formed are referred to hereafter as conventional, pressed, tissue paper structures. Such sheets are considered to be compacted since the entire web is subjected to substantial mechanical compressional forces while the fibers are moist and are then dried while in a compressed state.

The fibrous structure may be made with a fibrous furnish that produces a single layer embryonic fibrous web or a fibrous furnish that produces a multi-layer embryonic fibrous web. One or more short fibers may be present in a fibrous furnish with one or more long fibers. Further, one or more short fibers may be present in a furnish layer with one or more long fibers.

The fibrous structures of the present invention and/or paper products comprising such fibrous structures may have a basis weight of from about 12 g/m$^2$ to about 120 g/m$^2$ and/or from about 14 g/m$^2$ to about 80 g/m$^2$ and/or from about 20 g/m$^2$ to about 60 g/m$^2$.

The fibrous structures of the present invention and/or paper products comprising such fibrous structures may have a total dry tensile of greater than about 150 g/in and/or from about 200 g/in to about 1000 g/in and/or from about 250 g/in to about 850 g/in.

The fibrous structures of the present invention and/or paper products comprising such fibrous structures may have a wet burst strength of greater than about 25 g/in and/or from about 30 g/in to about 200 g/in and/or from about 150 g/in to about 500 g/in.

Short Fibers:

The short fibers of the present invention may have a length of from about 0.4 mm to about 1.2 mm and/or from about 0.5 mm to about 0.75 mm and/or from about 0.6 mm to about 0.7 mm and a coarseness of from about 3.0 mg/100 m to about 7.5 mg/100 m and/or from about 5.0 mg/100 m to about 7.5 mg/100 m and/or from about 6.0 mg/100 m to about 7.0 mg/100 m.

The short fibers of the present invention may be derived from a fiber source selected from the group consisting of Acacia, Eucalyptus, Maple, Oak, Aspen, Birch, Cottonwood, Alder, Ash, Cherry, Elm, Hickory, Poplar, Gum, Walnut, Locust, Sycamore, Beech, Catalpa, Sassafras, Gmelina, Albizia, Anthocephalus, Magnolia, Bagasse, Flax, Hemp, Kenaf and mixtures thereof.

In one embodiment, the short fibers are derived from tropical hardwood.

In another embodiment, the short fibers are derived from a fiber source selected from the group consisting of Acacia, Eucalyptus, Gmelina and mixtures thereof.

In another embodiment, the short fibers are derived from a fiber source selected from the group consisting of Acacia, Gmelina and mixtures thereof.

In yet another embodiment, the short fibers are derived from Acacia.

Nonlimiting examples of suitable short fibers having a length of from about 0.4 mm to about 1.2 mm and a coarseness of from about 3.0 mg/100 m to about 7.5 mg/100 m are commercially available from PT Tel of Indonesia.

The short fibers of the present invention may comprise cellulose and/or hemicellulose. Preferably, the fibers comprise cellulose.

The length and coarseness of the short fibers may be determined using a Kajaani FiberLab Fiber Analyzer commercially available from Metso Automation, Kajaani Finland. As used herein, fiber length is defined as the "length weighted average fiber length". The instructions supplied with the unit detail the formula used to arrive at this average. The recommended method used to determine fiber lengths and coarseness of fiber specimens essentially the same as detailed by the manufacturer of the Fiber Lab. However, the recommended consistencies for charging to the Fiber Lab are somewhat lower than recommended by the manufacturer since this gives more reliable operation. Short fiber furnishes, as defined herein, should be diluted to 0.02-0.04% prior to charging to the instrument. Long fiber furnishes, as defined herein, should be diluted to 0.15%-0.30%. Alternatively, the length and coarseness of the short fibers and/or long fibers may be determined by sending the short fibers and/or long fibers to an outside contract lab, such as Integrated Paper Services, Appleton, Wis.

The fibers of the present invention may be conventionally dried by non-through air drying processes and/or through air dried.

The lint value of the fibrous structures of the present invention and/or paper products comprising such fibrous structures may be greater than about 3.5 and/or greater than about 4 and/or greater than about 5 and/or from about 5 to about 8 and/or from about 8 to about 13.

Lint Method:

The amount of lint generated from a fibrous structure is determined with a Sutherland Rub Tester. This tester uses a motor to rub a weighted felt 5 times over the fibrous structure, while the fibrous structure is restrained in a stationary position. This fibrous structure can be is referred to throughout this method as the "web". The Hunter Color L value is measured before and after the rub test. The difference between these two Hunter Color L values is then use to calculate a lint value.

i. Sample Preparation

Prior to the lint rub testing, the samples to be tested should be conditioned according to Tappi Method #T402OM-88. Here, samples are preconditioned for 24 hours at a relative humidity level of 10 to 35% and within a temperature range of 22° C. to 40° C. After this preconditioning step, samples should be conditioned for 24 hours at a relative humidity of 48 to 52% and within a temperature range of 22° C. to 24° C. This rub testing should also take place within the confines of the constant temperature and humidity room.

The Sutherland Rub Tester may be obtained from Testing Machines, Inc. (Amityville, N.Y., 1701). The web is first prepared by removing and discarding any product which might have been abraded in handling, e.g. on the outside of the roll. For products formed from multiple plies of webs, this test can be used to make a lint measurement on the multi-ply product, or, if the plies can be separated without damaging the specimen, a measurement can be taken on the individual plies making up the product. If a given sample differs from surface to surface, it is necessary to test both surfaces and average the values in order to arrive at a composite lint value. In some cases, products are made from multiple-plies of webs such that the facing-out surfaces are identical, in which case it is only necessary to test one surface. If both surfaces are to be tested, it is necessary to obtain six specimens for testing (Single surface testing only requires three specimens). Each specimen should be folded in half such that the crease is running along the cross direction (CD) of the web sample. For two-surface testing, make up 3 samples with a first surface "out" and 3 with the second-side surface "out". Keep track of which samples are first surface "out" and which are second surface out.

Obtain a 30".times.40" piece of Crescent #300 cardboard from Cordage Inc. (800 E. Ross Road, Cincinnati, Ohio, 45217). Using a paper cutter, cut out six pieces of cardboard of dimensions of 2.5".times.6". Puncture two holes into each of the six cards by forcing the cardboard onto the hold down pins of the Sutherland Rub tester.

Center and carefully place each of the 2.5×6" cardboard pieces on top of the six previously folded samples. Make sure the 6" dimension of the cardboard is running parallel to the machine direction (MD) of each of the tissue samples. Center and carefully place each of the cardboard pieces on top of the three previously folded samples. Once again, make sure the 6" dimension of the cardboard is running parallel to the machine direction (MD) of each of the web samples.

Fold one edge of the exposed portion of the web specimen onto the back of the cardboard. Secure this edge to the cardboard with adhesive tape obtained from 3M Inc. (¾" wide Scotch Brand, St. Paul, Minn.). Carefully grasp the other over-hanging tissue edge and snugly fold it over onto the back of the cardboard. While maintaining a snug fit of the web specimen onto the board, tape this second edge to the back of the cardboard. Repeat this procedure for each sample.

Turn over each sample and tape the cross direction edge of the web specimen to the cardboard. One half of the adhesive tape should contact the web specimen while the other half is adhering to the cardboard. Repeat this procedure for each of the samples. If the tissue sample breaks, tears, or becomes frayed at any time during the course of this sample preparation procedure, discard and make up a new sample with a new tissue sample strip.

There will now be 3 first-side surface "out" samples on cardboard and (optionally) 3 second-side surface "out" samples on cardboard.

ii. Felt Preparation

Obtain a 30".times.40" piece of Crescent #300 cardboard from Cordage Inc. (800 E. Ross Road, Cincinnati, Ohio, 45217). Using a paper cutter, cut out six pieces of cardboard of dimensions of 2.25".times.7.25". Draw two lines parallel to the short dimension and down 1.125" from the top and bottom most edges on the white side of the cardboard. Carefully score the length of the line with a razor blade using a straight edge as a guide. Score it to a depth about half way through the thickness of the sheet. This scoring allows the cardboard/felt combination to fit tightly around the weight of the Sutherland Rub tester. Draw an arrow running parallel to the long dimension of the cardboard on this scored side of the cardboard.

Cut the six pieces of black felt (F-55 or equivalent from New England Gasket, 550 Broad Street, Bristol, Conn. 06010) to the dimensions of 2.25".times.8.5".times.0.0625". Place the felt on top of the unscored, green side of the cardboard such that the long edges of both the felt and cardboard are parallel and in alignment. Make sure the fluffy side of the felt is facing up. Also allow about 0.5" to overhang the top and bottom most edges of the cardboard. Snugly fold over both overhanging felt edges onto the backside of the cardboard with Scotch brand tape. Prepare a total of six of these felt/cardboard combinations.

For best reproducibility, all samples should be run with the same lot of felt. Obviously, there are occasions where a single lot of felt becomes completely depleted. In those cases where a new lot of felt must be obtained, a correction factor should be determined for the new lot of felt. To determine the correction factor, obtain a representative single web sample of interest, and enough felt to make up 24 cardboard/felt samples for the new and old lots.

As described below and before any rubbing has taken place, obtain Hunter L readings for each of the 24 cardboard/felt samples of the new and old lots of felt. Calculate the averages for both the 24 cardboard/felt samples of the old lot and the 24 cardboard/felt samples of the new lot.

Next, rub test the 24 cardboard/felt boards of the new lot and the 24 cardboard/felt boards of the old lot as described below. Make sure the same web lot number is used for each of the 24 samples for the old and new lots. In addition, sampling of the web in the preparation of the cardboard/ tissue samples must be done so the new lot of felt and the old lot of felt are exposed to as representative as possible of a tissue sample. Discard any product which might have been damaged or abraded. Next, obtain 48 web samples for the calibration. Place the first sample on the far left of the lab bench and the last of the 48 samples on the far right of the bench. Mark the sample to the far left with the number "1" in a 1 cm by 1 cm area of the corner of the sample. Continue to mark the samples consecutively up to 48 such that the last sample to the far right is numbered 48.

Use the 24 odd numbered samples for the new felt and the 24 even numbered samples for the old felt. Order the odd number samples from lowest to highest. Order the even numbered samples from lowest to highest. Now, mark the lowest number for each set with a letter "F" (for "first-side") Mark the next highest number with the letter "S" (for second-side). Continue marking the samples in this alternating "F"/"S" pattern. Use the "F" samples for first surface "out" lint analyses and the "S" samples for second-side surface "out" lint analyses. There are now a total of 24 samples for the new lot of felt and the old lot of felt. Of this 24, twelve are for first-side surface "out" lint analysis and 12 are for second-side surface "out" lint analysis.

Rub and measure the Hunter Color L values for all 24 samples of the old felt as described below. Record the 12 first-side surface Hunter Color L values for the old felt. Average the 12 values. Record the 12 second-side surface Hunter Color L values for the old felt. Average the 12 values. Subtract the average initial un-rubbed Hunter Color L felt reading from the average Hunter Color L reading for the first-side surface rubbed samples. This is the delta average difference for the first-side surface samples. Subtract the average initial un-rubbed Hunter Color L felt reading from the average Hunter Color L reading for the second-side surface rubbed samples. This is the delta average difference for the second-side surface samples. Calculate the sum of the delta average difference for the first-side surface and the delta average difference for the second-side surface and divide this sum by 2. This is the uncorrected lint value for the old felt. If there is a current felt correction factor for the old felt, add it to the uncorrected lint value for the old felt. This value is the corrected Lint Value for the old felt.

Rub and measure the Hunter Color L values for all 24 samples of the new felt as described below. Record the 12 first-side surface Hunter Color L values for the new felt. Average the 12 values. Record the 12 second-side surface Hunter Color L values for the new felt. Average the 12 values. Subtract the average initial un-rubbed Hunter Color L felt reading from the average Hunter Color L reading for the first-side surface rubbed samples. This is the delta average difference for the first-side surface samples. Subtract the average initial un-rubbed Hunter Color L felt reading from the average Hunter Color L reading for the second-side surface rubbed samples. This is the delta average difference for the second-side surface samples. Calculate the sum of the delta average difference for the first side surface and the delta average difference for the second-side surface and divide this sum by 2. This is the uncorrected lint value for the new felt.

Take the difference between the corrected Lint Value from the old felt and the uncorrected lint value for the new felt. This difference is the felt correction factor for the new lot of felt. Adding this felt correction factor to the uncorrected lint value for the new felt should be identical to the corrected Lint Value for the old felt. Note that the above procedure implies that the calibration is done with a two-surfaced specimen. If it desirable or necessary to do a felt calibration using a single-surfaced sample, it is satisfactory; however, the total of 24 tests should still be done for each felt.

iii. Care of 4 Pound Weight

The four pound weight has four square inches of effective contact area providing a contact pressure of one pound per square inch. Since the contact pressure can be changed by alteration of the rubber pads mounted on the face of the weight, it is important to use only the rubber pads supplied by the manufacturer (Brown Inc., Mechanical Services Department, Kalamazoo, Mich.). These pads must be replaced if they become hard, abraded or chipped off. When not in use, the weight must be positioned such that the pads are not supporting the full weight of the weight. It is best to store the weight on its side.

iv. Rub Tester Instrument Calibration

The Sutherland Rub Tester must first be calibrated prior to use. First, turn on the Sutherland Rub Tester by moving the tester switch to the "cont" position. When the tester arm is in its position closest to the user, turn the tester's switch to the "auto" position. Set the tester to run strokes by moving the pointer arm on the large dial to the "five" position setting. One stroke is a single and complete forward and reverse motion of the weight. The end of the rubbing block should be in the position closest to the operator at the beginning and at the end of each test.

Prepare a test specimen on cardboard sample as described above. In addition, prepare a felt on cardboard sample as described above. Both of these samples will be used for calibration of the instrument and will not be used in the acquisition of data for the actual samples.

Place this calibration web sample on the base plate of the tester by slipping the holes in the board over the hold-down pins. The hold-down pins prevent the sample from moving during the test. Clip the calibration felt/cardboard sample onto the four pound weight with the cardboard side contacting the pads of the weight. Make sure the cardboard/felt combination is resting flat against the weight. Hook this weight onto the tester arm and gently place the tissue sample underneath the weight/felt combination. The end of the weight closest to the operator must be over the cardboard of the web sample and not the web sample itself. The felt must rest flat on the tissue sample and must be in 100% contact with the web surface. Activate the tester by depressing the "push" button.

Keep a count of the number of strokes and observe and make a mental note of the starting and stopping position of the felt covered weight in relationship to the sample. If the total number of strokes is five and if the end of the felt covered weight closest to the operator is over the cardboard of the web sample at the beginning and end of this test, the tester is calibrated and ready to use. If the total number of strokes is not five or if the end of the felt covered weight closest to the operator is over the actual web sample either at the beginning or end of the test, repeat this calibration procedure until 5 strokes are counted the end of the felt covered weight closest to the operator is situated over the cardboard at the both the start and end of the test. During the actual testing of samples, monitor and observe the stroke count and the starting and stopping point of the felt covered weight. Recalibrate when necessary.

v. Hunter Color Meter Calibration

Adjust the Hunter Color Difference Meter for the black and white standard plates according to the procedures outlined in the operation manual of the instrument. Also run the stability check for standardization as well as the daily color stability check if this has not been done during the past eight hours. In addition, the zero reflectance must be checked and readjusted if necessary. Place the white standard plate on the sample stage under the instrument port. Release the sample stage and allow the sample plate to be raised beneath the sample port. Using the "L-Y", "a-X", and "b-Z" standardizing knobs, adjust the instrument to read the Standard White Plate Values of "L", "a", and "b" when the "L", "a", and "b" push buttons are depressed in turn.

vi. Measurement of Samples

The first step in the measurement of lint is to measure the Hunter color values of the black felt/cardboard samples prior to being rubbed on the web sample. The first step in this measurement is to lower the standard white plate from under the instrument port of the Hunter color instrument. Center a felt covered cardboard, with the arrow pointing to the back of the color meter, on top of the standard plate. Release the sample stage, allowing the felt covered cardboard to be raised under the sample port.

Since the felt width is only slightly larger than the viewing area diameter, make sure the felt completely covers the viewing area. After confirming complete coverage, depress the L push button and wait for the reading to stabilize. Read and record this L value to the nearest 0.1 unit.

If a D25D2A head is in use, lower the felt covered cardboard and plate, rotate the felt covered cardboard 90 degrees so the arrow points to the right side of the meter. Next, release the sample stage and check once more to make sure the viewing area is completely covered with felt. Depress the L push button. Read and record this value to the nearest 0.1 unit. For the D25D2M unit, the recorded value is the Hunter Color L value. For the D25D2A head where a rotated sample reading is also recorded, the Hunter Color L value is the average of the two recorded values.

Measure the Hunter Color L values for all of the felt covered cardboards using this technique. If the Hunter Color L values are all within 0.3 units of one another, take the average to obtain the initial L reading. If the Hunter Color L values are not within the 0.3 units, discard those felt/cardboard combinations outside the limit. Prepare new samples and repeat the Hunter Color L measurement until all samples are within 0.3 units of one another.

For the measurement of the actual web sample/cardboard combinations, place the web sample/cardboard combination on the base plate of the tester by slipping the holes in the board over the hold-down pins. The hold-down pins prevent the sample from moving during the test. Clip the calibration felt/cardboard sample onto the four pound weight with the cardboard side contacting the pads of the weight. Make sure the cardboard/felt combination is resting flat against the weight Hook this weight onto the tester arm and gently place the web sample underneath the weight/felt combination. The end of the weight closest to the operator must be over the cardboard of the web sample and not the web sample itself. The felt must rest flat on the web sample and must be in 100% contact with the web surface.

Next, activate the tester by depressing the "push" button. At the end of the five strokes the tester will automatically stop. Note the stopping position of the felt covered weight in relation to the sample. If the end of the felt covered weight toward the operator is over cardboard, the tester is operating properly. If the end of the felt covered weight toward the operator is over sample, disregard this measurement and recalibrate as directed above in the Sutherland Rub Tester Calibration section.

Remove the weight with the felt covered cardboard. Inspect the web sample. If torn, discard the felt and web sample and start over. If the web sample is intact, remove the felt covered cardboard from the weight. Determine the Hunter Color L value on the felt covered cardboard as described above for the blank felts. Record the Hunter Color L readings for the felt after rubbing. Rub, measure, and record the Hunter Color L values for all remaining samples. After all web specimens have been measured, remove and discard all felt. Felts strips are not used again. Cardboards are used until they are bent, torn, limp, or no longer have a smooth surface.

vii. Calculations

Determine the delta L values by subtracting the average initial L reading found for the unused felts from each of the measured values for the first-side surface and second-side surface sides of the sample as follows.

For samples measured on both surfaces, subtract the average initial L reading found for the unused felts from each of the three first-side surface L readings and each of the three second-side surface L readings. Calculate the average delta for the three first-side surface values. Calculate the average delta for the three second-side surface values. Subtract the felt factor from each of these averages. The final results are termed a lint for the first-side surface and a lint for the second-side surface of the web.

By taking the average of the lint value on the first-side surface and the second-side surface, the lint is obtained which is applicable to that particular web or product. In other words, to calculate lint value, the following formula is used:

$$\text{Lint Value} = \frac{\text{Lint Value, first-side} + \text{Lint Value, second-side}}{2}$$

For samples measured only for one surface, subtract the average initial L reading found for the unused felts from each of the three L readings. Calculate the average delta for the three surface values. Subtract the felt factor from this average. The final result is the lint value for that particular web or product.

Optional Ingredients:

The fibrous structures of the present invention may comprise an optional ingredient selected from the group consisting of permanent wet strength resins, chemical softeners, temporary wet strength resins, dry strength resins, wetting agents, lint resisting agents, absorbency-enhancing agents, immobilizing agents, especially in combination with emollient lotion compositions, antiviral agents including organic acids, antibacterial agents, polyol polyesters, antimigration agents, polyhydroxy plasticizers and mixtures thereof. Such optional ingredients may be added to the fiber furnish, the embryonic fibrous web and/or the dried fibrous structure. Such optional ingredients may be present in the fibrous structure at any level based on the dry weight of the fibrous structure.

The optional ingredients may be present in the fibrous structure at a level of from about 0.001 to about 50% and/or from about 0.001 to about 20% and/or from about 0.01 to about 5% and/or from about 0.03 to about 3% and/or from about 0.1 to about 1.0% by weight, on a dry fibrous structure basis.

Permanent Wet Strength Resins:

The fibrous structure of the present invention may comprise a permanent wet strength resin. The permanent wet strength resin may be present in the fibrous furnish, particularly, the short fiber furnish used to form the fibrous structure and/or can be deposited onto the embryonic fibrous web prior to drying of the embryonic fibrous web.

Nonlimiting examples of permanent wet strength resins include: polyamide-epicholorohydin resins, polyacrylamide resins, styrenebutadiene resins; insolubilized polyvinyl alcohol resins; urea-formaldehyde resins; polyethyleneimine resins; chitosan resins and mixtures thereof. Preferably, the permanent wet strength resins are selected from the group consisting of polyamide-epichiorohydrin resins, polyacrylainide resins and mixtures thereof.

Chemical Softeners:

The fibrous structure of the present invention may comprise a chemical softener. The chemical softener may be present in the fibrous furnish and/or applied to the embryonic fibrous web and/or applied to a dried fibrous structure.

The above listing of optional ingredients is intended to be merely exemplary in nature, and is not meant to limit the scope of the invention.

Processes of the Present Invention:

The fibrous structure of the present invention may be made by any suitable papermaking process.

A nonlimiting example of a suitable papermaking process for making the fibrous structure of the present invention is described as follows.

In one embodiment, a short fiber furnish is prepared by mixing a short fiber with water. One or more additional ingredients such as a physical property ingredient and/or optional ingredients may be added to the short fiber furnish. The short fiber furnish may then be put into a headbox of a papermaking machine. The short fiber furnish may then be deposited on a foraminous surface to form a single layer embryonic fibrous web. Physical property ingredients and/or optional ingredients may be added to the embryonic fibrous web by spraying and/or extruding and/or by any other suitable process known to those of ordinary skill in the art. The embryonic web may then be transferred to a through-air drying belt and/or a Yankee dryer such that the embryonic fibrous web is dried via through-air drying and/or via the Yankee dryer. From the through-air drying belt, if there is one present, the fibrous structure may be transferred to a Yankee dryer. From the Yankee dryer, the fibrous structure may be transferred to a roller. During this transfer step, physical property ingredients and/or optional ingredients may be applied to the fibrous structure. The fibrous structure may be converted into various paper products, particularly sanitary tissue products, both in single-ply forms and/or in multi-ply forms.

In another embodiment, a fibrous furnish is prepared by mixing a long fiber furnish with a short fiber furnish. The long fiber furnish may be made by mixing a long fiber with water. The short fiber furnish may be made by mixing a short fiber with water. The fibrous furnish may include one or more additional ingredients such as a physical property ingredient and/or optional ingredients. These one or more additional ingredients may be present in the long and/or short fiber furnish. The fibrous furnish may be placed in a layered headbox of a papermaking machine. The fibrous furnish may then be deposited on a foraminous surface to form a two (2) layer embryonic fibrous web. Physical property ingredients and/or optional ingredients may be added to the embryonic fibrous web by spraying and/or extruding and/or by any other suitable process known to those of ordinary skill in the art. The embryonic web may then be transferred to a through-air drying belt and/or a Yankee dryer such that the embryonic fibrous web is dried via through-air drying and/or via the Yankee dryer. From the through-air drying belt, if one is present, the fibrous structure may be transferred to a Yankee dryer. From the Yankee dryer, the fibrous structure may be transferred to a roller. During this transfer step, physical property ingredients and/or optional ingredients may be applied to the fibrous structure. The fibrous structure may be converted into various paper products, particularly sanitary tissue products, both in single-ply forms and/or in multi-ply forms. The paper products may be designed such that the surface of the paper product that is intended to contact a human's skin comprises a short fiber.

It is desirable that when the embryonic fibrous web comprises two or more layers, the short fiber furnish is in a layer that is not adjacent to the foraminous forming surface.

EXAMPLE 1

This Example illustrates a process incorporating a preferred embodiment of the present invention using the pilot scale Fourdrinier to make a facial tissue product. An aqueous slurry of Northern Softwood Kraft (NSK) of about 3% consistency is made up using a conventional pulper and is passed through a stock pipe toward the headbox of the Fourdrinier.

In order to impart a permanent wet strength to the finished product, a 1% dispersion of Hercules' Kymene 557 LX is prepared and is added to the NSK stock pipe at a rate sufficient to deliver 0.7% Kymene 557 LX based on the dry weight of the ultimate paper. The absorption of the permanent wet strength resin is enhanced by passing the treated slurry through an in-line mixer. Carboxymethyl cellulose (CMC) is added next to the NSK stock pipe after the in-line mixer. CMC is first dissolved in water and diluted to a solution strength of 1% by weight. Hercules CMC-7MT® is used to make-up the CMC solution. The aqueous solution of CMC is added to the aqueous slurry of NSK fibers at a rate of 0.15% CMC by weight based on the dry weight of the ultimate paper. The aqueous slurry of NSK fibers passes through a centrifugal stock pump to aid in distributing the CMC. The bonding inhibitor composition is added next. The bonding inhibitor composition is DiTallow Dimethyl Ammonium Methyl Sulfate (DTDMAMS). Pre-heated DTDMAMS (170° F.) is first slurried in water conditioned by pre-heating to 170° F. The water is agitated during addition of the DTDMAMS to aid in its dispersion. The concentration of the resultant DTDMAMS dispersion is 1% by weight, and it is added to the NSK stock pipe at a rate of 0.2% by weight DTDMAMS based on the dry weight of the ultimate paper. The NSK slurry is diluted with white water to about 0.2% consistency at the fan pump.

An aqueous slurry of acacia fibers (from PT Tel-Indonesia) of about 3% by weight is made up using a conventional repulper. The Acacia furnish has a weighted average fiber length of about 0.66 mm and a coarseness of about 7.1 mg/100 m.

The Acacia slurry passes to the second fan pump where it is diluted with white water to a consistency of about 0.2%.

The slurries of NSK and acacia are directed into a multi-channeled headbox suitably equipped with layering leaves to maintain the streams as separate layers until discharged onto a traveling Fourdrinier wire. A three-chambered headbox is used. The acacia slurry containing 64% of the dry weight of the ultimate paper is directed to the chambers leading to the outer layer, while the NSK slurry comprising 36% of the dry weight of the ultimate paper is directed to the chamber leading to the layer in contact with the wire and to the central layer. The NSK and acacia slurries are combined at the discharge of the headbox into a composite slurry.

The composite slurry is discharged onto the traveling Fourdrinier wire and is dewatered assisted by a deflector and vacuum boxes. The embryonic wet web is transferred from the Fourdrinier wire, at a fiber consistency of about 17% by weight at the point of transfer, to a patterned drying fabric. The drying fabric is designed to yield a pattern-densified tissue with discontinuous low-density deflected areas arranged within a continuous network of high density (knuckle) areas. This drying fabric is formed by casting an impervious resin surface onto a fiber mesh supporting fabric. The supporting fabric is a 48×52 filament, dual layer mesh. The thickness of the resin cast is about 12 mil above the supporting fabric. The knuckle area is about 30% and the open cells remain at a frequency of about 68 per square inch Further de-watering is accomplished by vacuum assisted drainage until the web has a fiber consistency of about 22% by weight. While remaining in contact with the patterned forming fabric, the patterned web is pre-dried by air blow-through pre-dryer to a fiber consistency of about 58% by weight.

The semi-dry web is then adhered to the surface of a Yankee dryer with a sprayed creping adhesive comprising a 0.250% aqueous solution of polyvinyl alcohol. The creping adhesive is delivered to the Yankee surface at a rate of 0.1% adhesive solids based on the dry weight of the web.

The fiber consistency is increased to about 98% before the web is dry creped from the Yankee with a doctor blade. The doctor blade has a bevel angle of about 20 degrees and is positioned with respect to the Yankee dryer to provide an impact angle of about 76 degrees. The Yankee dryer is operated at a temperature of about 325° F. and a speed of about 800 fpm (feet per minute) (about 244 meters per minute). The paper is wound in a roll using a surface driven reel drum having a surface speed of about 680 fpm (about 207 meters per minute), thus resulting in a crepe of about 15%. After the doctor blade, the web is calendared across all its width with a steel to rubber calender roll operating at a loading of 400 psi.

Resulting tissue has a basis weight of about 20 g/m2; a 1-ply total dry tensile between 210 g/in and 240 g/in, a 1-ply wet burst between 35 g/in and 65 g/in and a 2-ply caliper of about 0.020 inches. Resulting tissue is then plied together with a like sheet to form a two-ply, creped, pattern densified tissue so that the acacia fibers face the outside. CM849—an amino functional dimethyl polysiloxane sold by General Electric Silicones of Waterford, N.Y.—is added via slot extrusion onto both sides in contact with a human's skin, at an add-on amount of approximately 0.3-0.5 percent of silicone per ply based on the total weight of fibers. The resulting two-ply tissue exhibits a) a total basis weight of about 39 g/m2; b) a 2-ply total dry tensile between 350 g/in and 420 g/in; c) a 2-ply wet burst between 90 g/in and 130 g/in; d) a 4-ply caliper of about 0.028 inches; and e) a lint value of about 10.2. A comparative product is made in the same manner as this example except that a Eucalyptus bleached kraft fibrous pulp is substituted for the Acacia bleached kraft fibrous pulp. The Eucalyptus pulp furnish has a fiber length of 0.73 mm and a coarseness of 8.0 mg/100 m. Despite having comparable lint value, the resultant tissue paper using the comparative furnish is judged less soft by a panel of expert judges.

EXAMPLE 2

This Example illustrates a process incorporating a preferred embodiment of the present invention using the pilot scale Fourdrinier to make a toilet tissue product. An aqueous slurry of Northern Softwood Kraft (NSK) of about 3% consistency is made up using a conventional pulper and the furnish is passed through a stock pipe toward the headbox of the Fourdrinier.

In order aid in delivering a temporary wet strength to the finished product, a 1% dispersion of Cytec's Parez 750C is prepared and is added to the NSK stock pipe at a rate sufficient to deliver 0.2% of the resin based on the dry weight of the ultimate paper. The absorption of the temporary wet strength resin is enhanced by passing the treated slurry through an in-line mixer.

The NSK slurry furnish is diluted with white water to about 0.2% consistency at the fan pump.

An aqueous slurry of Acacia bleached kraft fibrous pulp (from PT Tel-Indonesia) of about 3% by weight is made up using a conventional repulper and the furnish is passed through a stock pipe toward the headbox of the Fourdrinier. The Acacia furnish has a weighted average fiber length of about 0.66 mm and a coarseness of about 7.1 mg/100 m. In order to aid in delivering temporary wet strength to the finished product, the 1% dispersion of Cytec's Parez 750C is also added to the Acacia stock pipe at a rate sufficient to deliver 0.05% of the resin based on the dry weight of the ultimate paper. The absorption of the temporary wet strength resin is enhanced by passing the treated slurry through an in-line mixer.

The Acacia slurry furnish passes to the second fan pump where it is diluted with white water to a consistency of about 0.2%.

The slurries of NSK and acacia are directed into a multi-channeled headbox suitably equipped with layering leaves to maintain the streams as separate layers until discharged onto a traveling Fourdrinier wire. A three-chambered headbox is used. The acacia slurry containing 70% of the dry weight of the ultimate paper is directed to the chambers leading to the outer layers, while the NSK slurry comprising 30% of the dry weight of the ultimate paper is directed to the chamber leading to the central layer.

The NSK and acacia slurries are combined at the discharge of the headbox into a composite slurry and the composite slurry is discharged onto the traveling Fourdrinier wire and is dewatered assisted by a deflector and vacuum boxes. The embryonic wet web is transferred from the Fourdrinier wire, at a fiber consistency of about 15% at the point of transfer, to a patterned drying fabric. The drying fabric is designed to yield a pattern-densified tissue with discontinuous low-density deflected areas arranged within a continuous network of high density (knuckle) areas. This drying fabric is formed by casting an impervious resin surface onto a fiber mesh supporting fabric. The supporting fabric is a 45×52 filament, dual layer mesh. The thickness of the resin cast is about 10 mil above the supporting fabric. The knuckle area is about 40% and the open cells remain at a frequency of about 78 per square inch.

Further de-watering is accomplished by vacuum assisted drainage until the web has a fiber consistency of about 30%. While remaining in contact with the patterned forming fabric, the patterned web is pre-dried by air blow-through pre-dryers to a fiber consistency of about 65% by weight. The semi-dry web is then transferred to the Yankee dryer and adhered to the surface of the Yankee dryer with a sprayed creping adhesive comprising a 0.125% aqueous solution of polyvinyl alcohol. The creping adhesive is delivered to the Yankee surface at a rate of 0.1% adhesive solids based on the dry weight of the web. The fiber consistency is increased to about 98% before the web is dry creped from the Yankee with a doctor blade.

The doctor blade has a bevel angle of about 25 degrees and is positioned with respect to the Yankee dryer to provide an impact angle of about 81 degrees. The Yankee dryer is operated at a temperature of about 350° F. (177° C.) and a speed of about 800 fpm (feet per minute) (about 244 meters per minute). The paper is wound in a roll using a surface driven reel drum having a surface speed of about 656 feet per minute. The resulting tissue paper web is converted into a single-ply toilet tissue paper product using a conventional tissue winding stand. The finished product has a basis weight of about 21 lb/3000 ft2; a total dry tensile of 547 g/in and a density of 0.063 g/Cm$^3$. The lint value is measured to be 5.7. A comparative product is made in the same manner as this example except that a Eucalyptus bleached kraft fibrous pulp is substituted for the Acacia bleached kraft fibrous pulp. The Eucalyptus pulp furnish has a fiber length of 0.73 mm and a coarseness of 8.0 mg/100 m. Despite having comparable lint value, the resultant tissue paper using the comparative furnish is judged less soft by a panel of expert judges.

EXAMPLE 3

Example 2 is repeated except that the furnish flow rates are adjusted in order to reduce the basis weight of the fibrous web in order to make a two ply tissue web product. Preparation of the two ply product is completed by simultaneously unwinding two rolls of fibrous web combining them into a two-ply bath by a narrow, approximately ½" stripe of pressure sensitive adhesive which allows the plies to maintain their ability to slip relative to one another. The combining is completed so that the respective Yankee-side surfaces of each ply contact each other. The finished product has a basis weight of about 28 lb/3000 ft2; a total dry tensile of 450 g/in and a density of 0.057 g/cm$^3$. Again, a comparative product is made in the same manner as this example except that the Eucalyptus bleached kraft fibrous pulp is substituted for the Acacia bleached kraft fibrous pulp. Again, the resultant tissue paper of comparable lint using the comparative furnish is judged less soft by a panel of expert judges.

While particular embodiments and/or individual features of the present invention have been illustrated and described, it would be obvious to those skilled in the art that various other changes and modifications can be made without departing from the spirit and scope of the invention. Further, it should be apparent that all combinations of such embodiments and features are possible and can result in preferred executions of the invention. Therefore, the appended claims are intended to cover all such changes and modifications that are within the scope of this invention.

What is claimed is:

1. A layered fibrous structure comprising a fiber furnish comprising at least 64% of the total fibers of the fibrous structure of short fibers selected from the group consisting of acacia fibers, eucalyptus fibers and mixtures thereof; at least 20% up to 100% by weight of the total fibers of the fibrous structure comprise acacia fibers present on a surface of the fibrous structure, wherein the fibrous structure exhibits a greater softness than such a fibrous structure without the acacia fibers and wherein the fibrous structure exhibits a lint value of greater than about 3.5.

2. The fibrous structure according to claim 1 wherein the fibrous structure further comprises a long fiber having a length greater than 1.2 mm.

3. The fibrous structure according to claim 1 wherein the fibrous structure has a basis weight greater than about 12 g/m$^2$ to about 120 g/m$^2$.

4. The fibrous structure according to claim 1 wherein the fibrous structure has a total dry tensile greater than about 150 g/in and a wet burst strength greater than about 25 g/in.

5. The fibrous structure according to claim 1 wherein the fibrous structure is a through air dried fibrous structure.

6. The fibrous structure according to claim 1 wherein the surface of the fibrous structure having the acacia fibers was not adjacent to the foraminous forming surface during formation.

7. The fibrous structure according to claim 1 wherein the surface having the acacia fibers further comprises an optional ingredient selected from the group consisting of permanent wet strength resins, chemical softeners, temporary wet strength resins, dry strength resins, wetting agents, lint resisting agents, absorbency-enhancing agents, immobilizing agents, emollient lotion compositions, antiviral agents, antibacterial agents, polyol polyesters, antimigration agents, polyhydroxy plasticizers and mixtures thereof.

8. A single- or multi-ply sanitary tissue product comprising a fibrous structure according to claim 1.

9. The sanitary tissue product according to claim 8 wherein the sanitary tissue product exhibits a lint value of from about 3.5 to about 15.

10. The sanitary tissue product according to claim 8 wherein the sanitary tissue product comprises two plies of the fibrous structure according to claim 1.

* * * * *

UNITED STATES PATENT AND TRADEMARK OFFICE

CERTIFICATE OF CORRECTION

PATENT NO. : 7,381,297 B2
APPLICATION NO. : 10/374559
DATED : June 3, 2008
INVENTOR(S) : Diego Antonio Hernandez-Munoa et al.

It is certified that error appears in the above-identified patent and that said Letters Patent is hereby corrected as shown below:

In Col. 12, line 22, the words "run strokes" should be run 5 strokes

Signed and Sealed this

Twelfth Day of May, 2009

JOHN DOLL
*Acting Director of the United States Patent and Trademark Office*